US005456467A

United States Patent [19]

Hoover

[11] Patent Number: 5,456,467

[45] Date of Patent: Oct. 10, 1995

[54] METHOD OF PLAYING A POKER DICE GAME

[76] Inventor: Betty L. Hoover, HC 61, Box 113, Cass, W. Va. 24927

[21] Appl. No.: 386,106

[22] Filed: Feb. 9, 1995

[51] Int. Cl.[6] ..... A63F 9/04

[52] U.S. Cl. ..... 273/146

[58] Field of Search ..... 273/146, 145 R, 273/145 A, 145 B, 145 C, 145 CA, 145 D, 145 E, 274

[56] References Cited

U.S. PATENT DOCUMENTS

| | | | |
|---|---|---|---|
| 3,747,935 | 7/1973 | Engelbrecht | 273/138 R |
| 4,648,602 | 3/1987 | Maroney | 273/146 |
| 4,834,386 | 5/1989 | Rosenthal et al. | 273/146 |
| 4,893,816 | 1/1990 | Levy et al. | 273/146 |
| 4,930,780 | 6/1990 | Goodman et al. | 273/146 |
| 5,031,914 | 7/1991 | Rosenthal et al. | 273/146 |
| 5,388,830 | 2/1995 | Dixson | 273/146 |

*Primary Examiner*—Benjamin H. Layno

[57] ABSTRACT

A dice game for entertaining players. The inventive game utilizes a plurality of dice and may include score cards, a rule book, a dice agitator cup, and a storage box. A method of play of the game includes rolling up to five dice and computing a score in accordance with the numbers generated. Score is kept for each player with the winner being declared as the player obtaining a score within a predetermined scoring window or spread.

11 Claims, 3 Drawing Sheets

METHOD OF PLAYING A POKER DICE GAME

BACKGROUND OF THE INVENTION

1. Field of the Invention

The present invention relates to random number games and more particularly pertains to a poker dice game for entertaining players.

2. Description of the Prior Art

The use of random number Games is known in the prior art. More specifically, random number games heretofore devised and utilized are known to consist basically of familiar, expected and obvious structural configurations, notwithstanding the myriad of designs encompassed by the crowded prior art which have been developed for the fulfillment of countless objectives and requirements.

Known prior art random number games include U.S. Pat. Nos. 5,183,256; 5,133,559; 5,125,660; 5,031,913; and 4,834,386.

While these devices fulfill their respective, particular objectives and requirements, the aforementioned patents do not disclose a poker dice game for entertaining players which includes rolling up to five dice and computing a score in accordance with numbers generated, wherein score is kept with the winner being declared as a player obtaining a score within a predetermined scoring window or spread.

In these respects, the poker dice game according to the present invention substantially departs from the conventional concepts and designs of the prior art, and in so doing provides an apparatus primarily developed for the purpose of entertaining players.

SUMMARY OF THE INVENTION

In view of the foregoing disadvantages inherent in the known types of random number games now present in the prior art, the present invention provides a new poker dice game construction wherein the same can be utilized for entertaining players of the game. As such, the general purpose of the present invention, which will be described subsequently in greater detail, is to provide a new poker dice game apparatus and method which has many of the advantages of the random number games mentioned heretofore and many novel features that result in a poker dice game which is not anticipated, rendered obvious, suggested, or even implied by any of the prior art random number games, either alone or in any combination thereof.

To attain this, the present invention generally comprises a dice game for entertaining players. The inventive game utilizes a plurality of dice and may include score cards, a rule book, a dice agitator cup, and a storage box. A method of play of the game includes rolling up to five dice and computing a score in accordance with the numbers generated. Score is kept for each player with the winner being declared as the player obtaining a score within a predetermined scoring window or spread.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new poker dice game apparatus and method which has many of the advantages of the random number games mentioned heretofore and many novel features that result in a poker dice game which is not anticipated, rendered obvious, suggested, or even implied by any of the prior art random number games, either alone or in any combination thereof.

It is another object of the present invention to provide a new poker dice game which may be easily and efficiently manufactured and marketed.

It is a further object of the present invention to provide a new poker dice game which is of a durable and reliable construction.

An even further object of the present invention is to provide a new poker dice game which is susceptible of a low cost of manufacture with regard to both materials and labor, and which accordingly is then susceptible of low prices of sale to the consuming public, thereby making such poker dice games economically available to the buying public.

Still yet another object of the present invention is to provide a new poker dice game which provides in the apparatuses and methods of the prior art some of the advantages thereof, while simultaneously overcoming some of the disadvantages normally associated therewith.

Still another object of the present invention is to provide a new poker dice game for entertaining players during play of the game.

Yet another object of the present invention is to provide a new poker dice game which includes rolling up to five dice and computing a score in accordance with numbers generated, wherein score is kept with the winner being declared as a player obtaining a score within a predetermined scoring window or spread.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
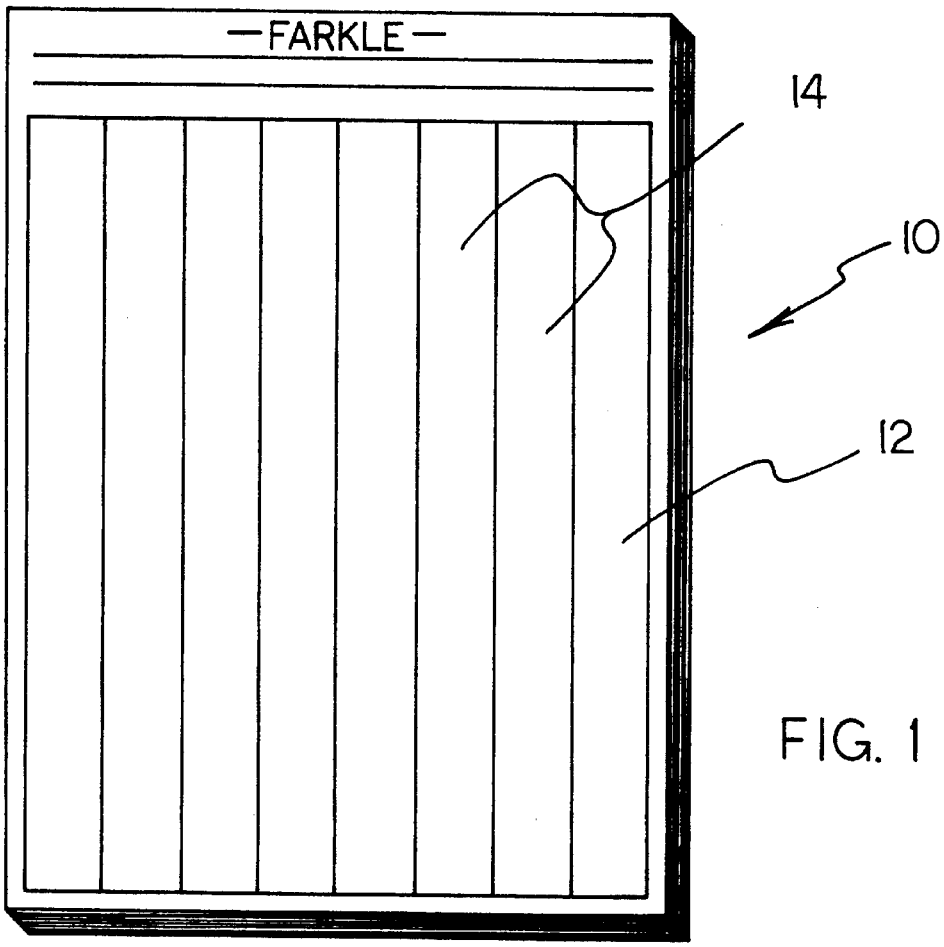
FIG. 1 is a front elevation view of a plurality of score cards according to the present invention.

With reference now to the drawings, and in particular to FIGS. 1–6 thereof, a new poker dice game embodying the principles and concepts of the present invention and generally designated by the reference numeral 10 will be described.

Figure 2:
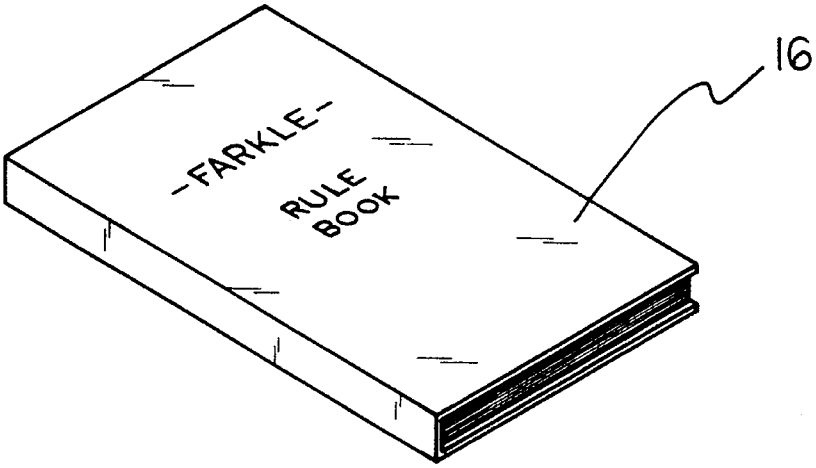
FIG. 2 is an isometric illustration of a rule book containing a method of play of the game.
Figure 3:
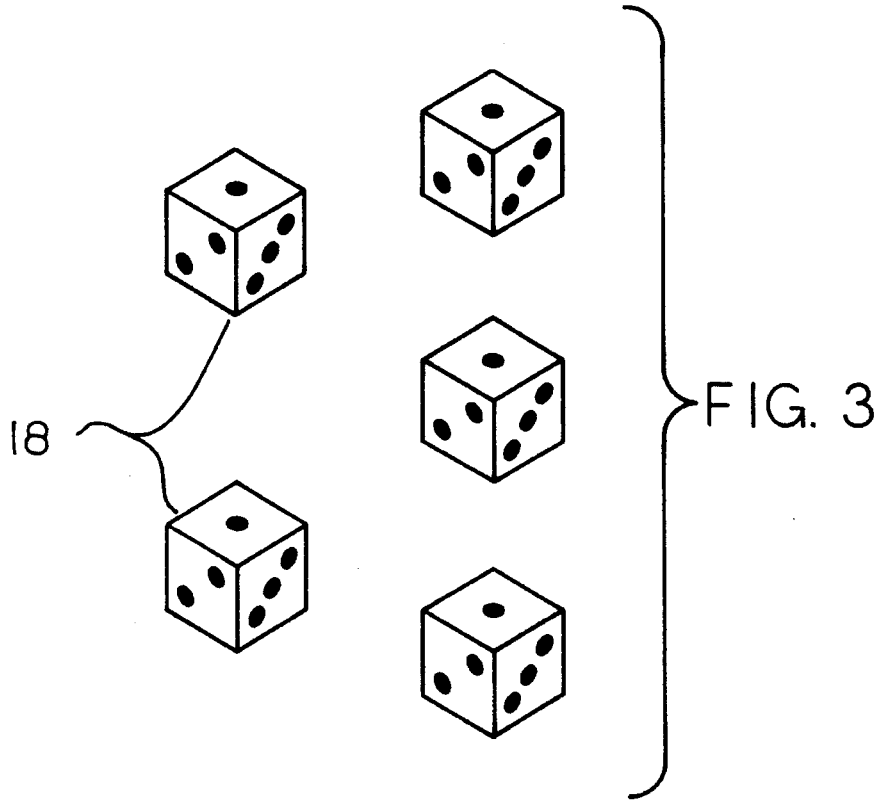
FIG. 3 is an isometric illustration of a plurality of dice utilized according to the present invention.
Figure 4:
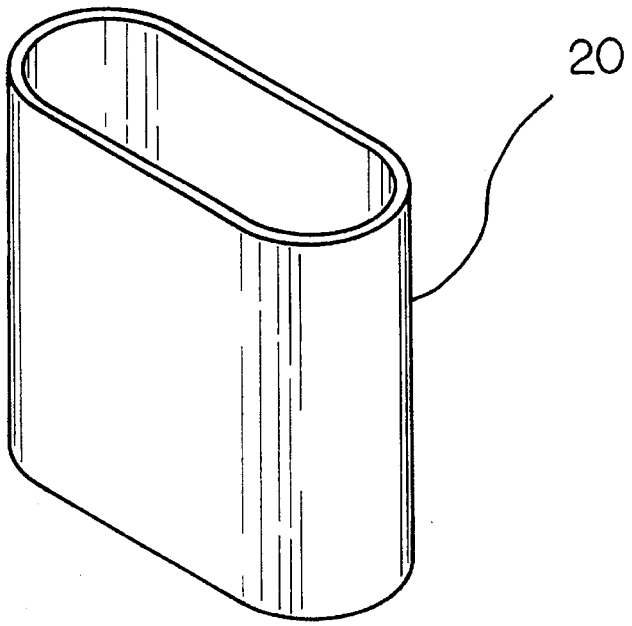
FIG. 4 is an isometric illustration of a dice agitator cup which can be utilized with the method of play.
Figure 5:
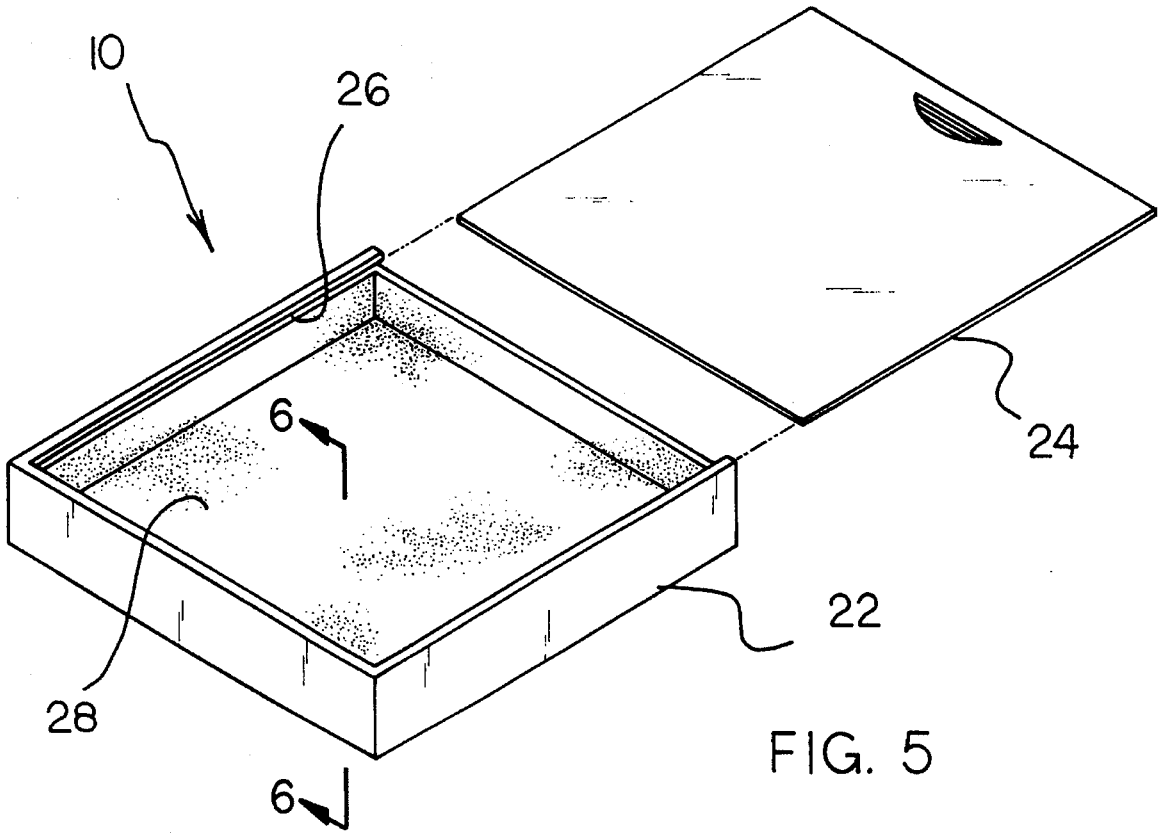
FIG. 5 is an exploded isometric illustration of a storage box of the invention.
Figure 6:
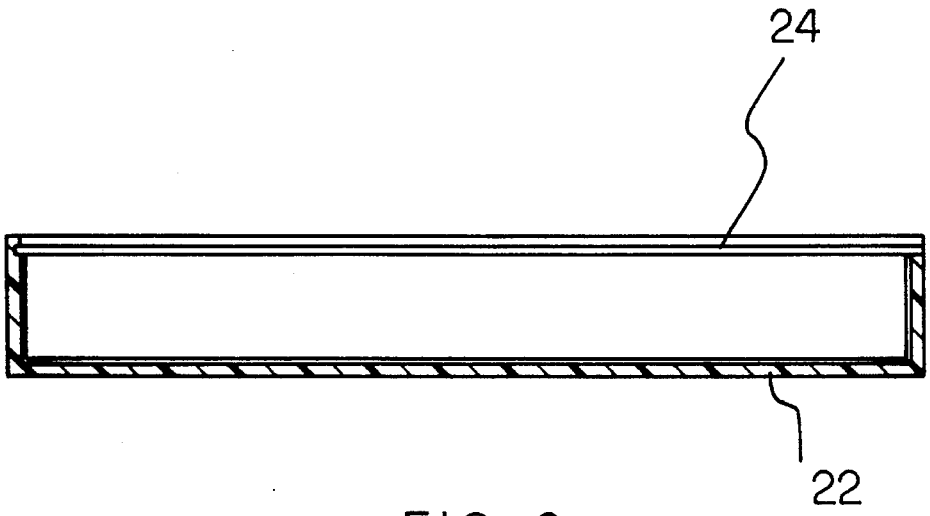
FIG. 6 is a cross-sectional view taken along line 6—6 of FIG. 5.

More specifically, it will be noted that the poker dice game 10 comprises a plurality of score cards 12 each including a plurality of blank columns 14 within which scores and numerical calculations can be positioned. As shown in FIG. 2, the method of play of the game 10 can be printed within a rule book 16 for convenient reference by all players. FIG. 3 illustrates that the device 10 preferably includes five dice 18. A dice agitator cup 20, as shown in FIG. 4, can be provided to agitate the dice 18 during play of the game. As shown in FIGS. 5 and 6, a storage box 22 having a removable lid 24 received within opposed channels 26 of the box can be provided to removably contain the components 12–20 of the invention 10. Preferably, an interior surface of the storage box 22 is lined with a felt material 28 so as to cushion an impact of the dice 18 into the storage box 22 during play of the game 10. In other words, the storage box 22 can double as a dice receiving box during play of the game 10, wherein players randomly throw dice into the box.

The method of play of the game 10 according to the present invention comprises allowing each player to roll one of the dice 18. The player who rolls the highest number will play first with play continuing in a preferably clockwise manner about a table or other structure around which the players are positioned. To play a round of the game, each player rolls between one and five of the dice 18. The roll of the dice must generate at least one die 18 having the number one showing, at least one die having the number five showing, or three dice having the same number showing, or five dice having the same number showing, or all five dice arranged in an ascending orientation including the numbers one, two, three, four and five. If a player rolls all five dice 18 and does not have a one, a five, a three or five of a kind, or a straight, the player has what is referred to as a "FARKLE!" Upon receiving a "FARKLE!" the player loses his turn. The next player situated in a clockwise adjacent orientation relative to the first player can now roll the dice 18. The "FARKLES" are recorded on the score cards 12. When a player accumulates a total of five "FARKLES", one thousand points are deducted from the player's score. When a player accumulates a total of ten "FARKLES", the player is removed from the game.

Points are awarded to the player in accordance with the following score table:

POINT SYSTEM:

One (1)=100 pts.

Five (5)=50 pts.

Three (3) of a kind: (MUST BE IN ONE ROLL)

One (1's)=1,000 pts.

Twos (2's)=200 pts.

Threes (3's)=300 pts.

Fours (4's)=400 pts.

Fives (5's)=500 pts.

Sixes (6's)=600 pts.

Five (5) of a kind: (MUST BE IN ONE ROLL)

Ones (1's)=1,000 pts.

Twos (2's)=2,000 pts.

Threes (3's)=3,000 pts

Fours (4's)=4,000 pts.

Fives (5's)=5,000 pts.

Sixes (6's)=6,000 pts.

Straight: (MUST BE IN ONE ROLL)

One (1), Two (2), Three (3), Four (4), and Five (5)=1,500 pts.

Each player's score can be computed and recorded within an individual one of the blank columns 14 of the score cards 12 during play of the game 10. It should be noted that each player must roll a total of 650 points before that player can be awarded any points at all. In other words, a player obtaining less than 650 points during any initial play of the game is awarded a total of zero points. Each player has a choice of the number of dice 18 rolled during each play of the game and can also choose to stop rolling the dice at any time and add the total points accumulated during that play of the game to the score of that player. It should be noted that at least one of the dice 18 must be scored on each roll. Further, anytime that all five are utilized during computation of the player's score, the player must roll all five dice again. In other words, if a player rolls a straight or a five of a kind, the player must again roll all five dice.

The winner of the game is defined as the player having a score between 10,000 points and 10,150 points. If a player's score exceeds 10,150 points, a total of 1,000 points are deducted from the player's total score prior to the next roll.

An example of play of the game 10 is as follows: One player rolls all five dice 18. The dice come to rest with two ones (1), a four (4), and two fives (5) showing. The player can choose at this point to keep the ones (1) and fives (5), and to roll the four (4); to keep the ones (1) and roll the remaining three dice in hopes of getting more ones; or to cease rolling of the dice and compute the points. In this case, the two ones (1) rolled equal 200 points and the two fives (5) rolled equal 100 points for a total of 300 points added to that player's score. The play is then transferred to the next player.

In use, the poker dice game 10 according to the present invention can be easily played and scored in accordance with the above detailed method. The game can be played with any number of players as desired and can be easily carried or transported within the storage box 22 if so desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a poker dice game comprising the steps of:

(a) providing a plurality of dice each die having a number one (1) on at least one of its faces, a number two (2) on at least another one of its faces, a number three (3) on at least another one of its faces, a number four (4) on at least another one of its faces and a number five (5) on at least another one of its faces;

(b) assigning a turn to each player;

(c) during the player's turn, the player rolling between one and five of the dice;

(d) assigning a "FARKLE" to the player who has generated a roll not found within the group consisting of: at least one of the dice having a number one (1) showing; at least one die having the number five (5) showing; at least three dice having the same number showing; five dice having the same number showing; and all five dice arranged in an ascending orientation including the numbers one (1), two (2), three (3), four (4) and five (5);

(e) awarding points to the player when the player's roll is found within the group listed in (d);

(f) allowing the player to continue rolling said dice as long as the player is awarded points for each roll;

(g) adding said awarded points to a player's score;

(h) recording a received "FARKLE";

(i) tabulating a cumulative number of "FARKLES" received, and subtracting points from the player's score when the player accumulates a first number of "FARKLES";

(j) tabulating a cumulative number of "FARKLES" received, and removing the player from the game when the player accumulates a second number of "FARKLES";

(k) losing the player's turn if the player receives a "FARKLE" and passing the turn to the next player;

(l) repeating steps (c)–(k).

2. The method of playing a poker dice game of claim 1, wherein the step (g) comprises:

awarding a third number of points to the player for one of the dice showing a one (1);

awarding a fourth number of points to the player for one of the dice showing a five (5);

awarding a fifth number of points to the player for at least three of the dice showing a one (1);

awarding a sixth number of points to the player for at least three of the dice showing a two (2);

awarding a seventh number of points to the player for at least three of the dice showing a three (3);

awarding an eighth number of points to the player for at least three of the dice showing a four (4);

awarding a ninth number of points to the player for at least three of the dice showing a five (5);

awarding a tenth number of points to the player for at least three of the dice showing a six (6).

3. The method of playing a poker dice game of claim 2, wherein the step (g) further comprises:

awarding an eleventh number of points to the player for at least five of the dice showing a one (1);

awarding a twelfth number of points to the player for at least five of the dice showing a two (2);

awarding a thirteenth number of points to the player for at least five of the dice showing a three (3);

awarding a fourteenth number of points to the player for at least five of the dice showing a four (4);

awarding a fifteenth number of points to the player for at least five of the dice showing a five (5);

awarding a sixteenth number of points to the player for at least five of the dice showing a six (6).

4. The method of playing a poker dice game of claim 3, wherein the step (g) yet further comprises:

awarding an eighteenth number of points to the player for having at least one dice showing a one (1); at least one dice showing a two (2); at least one dice showing a three (3); at least one dice showing a four (4); and at least one dice showing a five (5).

5. The method of playing a poker dice game of claim 4, wherein the step (g) yet further comprises recording score only to the player when an initial minimum of points has been awarded to the player.

6. The method of playing a poker dice game of claim 5, and further comprising the step of:

declaring a winner of the game as a player who records a score residing between a nineteenth number and a twentieth number.

7. The method of playing a poker dice game of claim 6, and further comprising the step of:

deducting points from a recorded score of a player exceeding the twentieth number.

8. A method of playing a poker dice game comprising the steps of:

(a) providing a plurality of dice each dice having a number one (1) on at least one of its faces, a number two (2) on at least another one of its faces, a number three (3) on at least another one of its faces, a number four (4) on at least another one of its faces and a number five (5) on at least another one of its faces;

(b) assigning a turn to each player;

(c) during the player's turn, the player rolling at least one of the dice;

(d) assigning a "FARKLE" to the player who has generated a roll not found within the group consisting of: at least one of the dice having a number one (1) showing;

at least one dice having the number five (5) showing; at least three dice having the same number showing; five dice having the same number showing; and all five dice arranged in an ascending orientation including the numbers one (1), two (2), three (3), four (4) and five (5);

(e) awarding points to the player when the player's roll is found within the group listed in (d);

(f) allowing the player to continue rolling said dice as long as the player is awarded points for each roll;

(g) adding said awarded points to a player's score;

(h) recording a received "FARKLE";

(i) tabulating a cumulative number of "FARKLES" received, and subtracting points from the player's score when the player accumulates a first number of "FARKLES";

(j) tabulating a cumulative number of "FARKLES" received, and removing the player from the game when the player accumulates a second number of "FARKLES";

(k) losing the player's turn if the player receives a "FARKLE" and passing the turn to the next player;

(1) repeating steps (c)–(k).

9. The method of playing a poker dice game of claim 8, wherein the step (g) further comprises recording score only to the player when an initial minimum of points has been awarded to the player.

10. The method of playing a poker dice game of claim 8, and further comprising the step of:

declaring a winner of the game as a player who records a score residing between a first number and a second number.

11. The method of playing a poker dice game of claim 10, and further comprising the step of:

deducting points from a recorded score of a player exceeding the second number.

* * * * *